US009320304B1

(12) United States Patent
Sanders

(10) Patent No.: US 9,320,304 B1
(45) Date of Patent: Apr. 26, 2016

(54) FOOD APRON

(71) Applicant: Cosby D. Sanders, Birmingham, AL (US)

(72) Inventor: Cosby D. Sanders, Birmingham, AL (US)

( * ) Notice: Subject to any disclaimer, the term of this patent is extended or adjusted under 35 U.S.C. 154(b) by 0 days.

(21) Appl. No.: 14/281,611

(22) Filed: May 19, 2014

Related U.S. Application Data

(60) Provisional application No. 61/824,580, filed on May 17, 2013.

(51) Int. Cl.
*A41B 13/10* (2006.01)
*A41D 11/00* (2006.01)
*A41F 1/00* (2006.01)

(52) U.S. Cl.
CPC ..... *A41B 13/103* (2013.01); *A41D 11/00* (2013.01); *A41F 1/002* (2013.01)

(58) Field of Classification Search
CPC ..... A41D 13/04; A41B 13/10; A41B 13/103
USPC ..... 2/48, 49.1, 49.2, 49.3, 49.4, 52, 80, 82
See application file for complete search history.

(56) References Cited

U.S. PATENT DOCUMENTS

| | | | | | |
|---|---|---|---|---|---|
| 996,084 | A * | 6/1911 | Herring | 2/49.2 |
| 3,010,111 | A * | 11/1961 | Ralph | 2/49.3 |
| 3,945,048 | A * | 3/1976 | Shearer | 2/48 |
| 4,924,527 | A * | 5/1990 | Hintermeyer | 2/46 |
| 5,504,941 | A * | 4/1996 | Sell | 2/49.2 |
| 6,256,788 | B1 * | 7/2001 | Loewer et al. | 2/49.2 |
| 7,269,857 | B2 * | 9/2007 | Cymbol | 2/49.2 |
| 7,380,284 | B1 * | 6/2008 | Dodani | 2/49.1 |
| 7,383,589 | B2 * | 6/2008 | Friedland et al. | 2/49.2 |
| 7,418,739 | B2 * | 9/2008 | Chan | 2/48 |
| 7,444,685 | B2 * | 11/2008 | Rose | 2/49.2 |
| 7,484,249 | B1 * | 2/2009 | Reese et al. | 2/48 |
| 7,526,815 | B1 * | 5/2009 | Kelly | 2/49.1 |

* cited by examiner

*Primary Examiner* — Tejash Patel

(57) ABSTRACT

The present disclosure generally pertains to a bib or apron for use by infants, young children, older adults or person with special needs to protect their clothing and/or furniture from food and liquid spills. The apron is created form a unitary piece of material and includes a flexible pocket created by folding the bottom portion of the garment upward. The apron further includes two or more bifold straps that are placed along the sides of the garment. The bifold straps are wrapped around the bottom of the apron and are secured to the back of the apron via two or more attachment devices to maintain the integrity of the flexible pocket. Detachment of the bifold straps causes the front pocket to easily disassemble, allowing for easy cleaning of the apron after use. The apron further includes a pocket located on the back side of the garment for storage of feeding accessories.

2 Claims, 9 Drawing Sheets

FOOD APRON

CROSS REFERENCE TO RELATED APPLICATION

This application claims priority to U.S. Provisional Patent Application No. 61/824,580, entitled "Food Apron" and filed on May 17, 2013, which is incorporated herein by reference.

RELATED ART

A number of bib garments have been developed or proposed for use by infants, young children, older adults or person with special needs to protect their clothing and/or furniture from food and liquid spills, drooling, and the like. Conventional bibs are useful to protect clothing located on the upper body of the user. However, conventional bibs are problematic in that spilled food or liquids may slide down the front of the bib and deposit on the user's pants, or soil the table where the user is sitting. Bibs with receptacles placed on the front side of the bib are often used to catch liquid or solid food products as they travel down the front of the bib. However, these receptacles are generally permanently attached to the front of the bib, making it difficult to remove food from the receptacle and clean the bib after use. In addition, many of the receptacles are stiff and inflexible, decreasing the comfort of the wearer and interfering with placement of the bib between the chest of the user and the table where the food is placed.

BRIEF DESCRIPTION OF THE DRAWINGS

The disclosure can be better understood with reference to the following drawings. The elements of the drawings are not necessarily to scale relative to each other, emphasis instead being placed upon clearly illustrating the principles of the disclosure. Furthermore, like reference numerals designate corresponding parts throughout the several views.

DETAILED DESCRIPTION

The present disclosure generally pertains to a bib or apron for use by infants, young children, older adults or person with special needs to protect their clothing and/or furniture from food and liquid spills. The apron is created form a unitary piece of material and includes a flexible pocket created by folding the bottom portion of the garment upward. The apron further includes two or more bifold straps that are placed along the sides of the garment. The bifold straps are wrapped around the bottom of the apron and are secured to the back of the apron via two or more attachment devices. Securing the bifold straps to the back of the apron maintains the integrity of the flexible pocket. Detachment of the bifold straps from the attachment devices causes the front pocket to easily disassemble, allowing for easy cleaning of the apron after use. In additional embodiment, the apron further includes a pocket located on the back side of the garment for storage of feeding accessories, such as washcloth or baby wipes.

Figure 2:
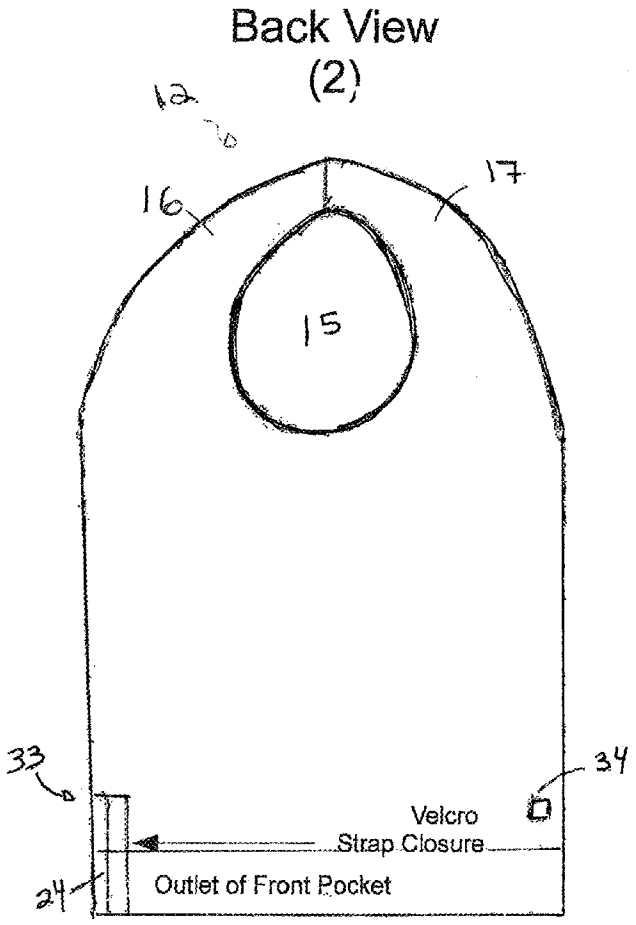
FIG. 2 depicts an exemplary embodiment of the front back of a food apron.
Figure 1:
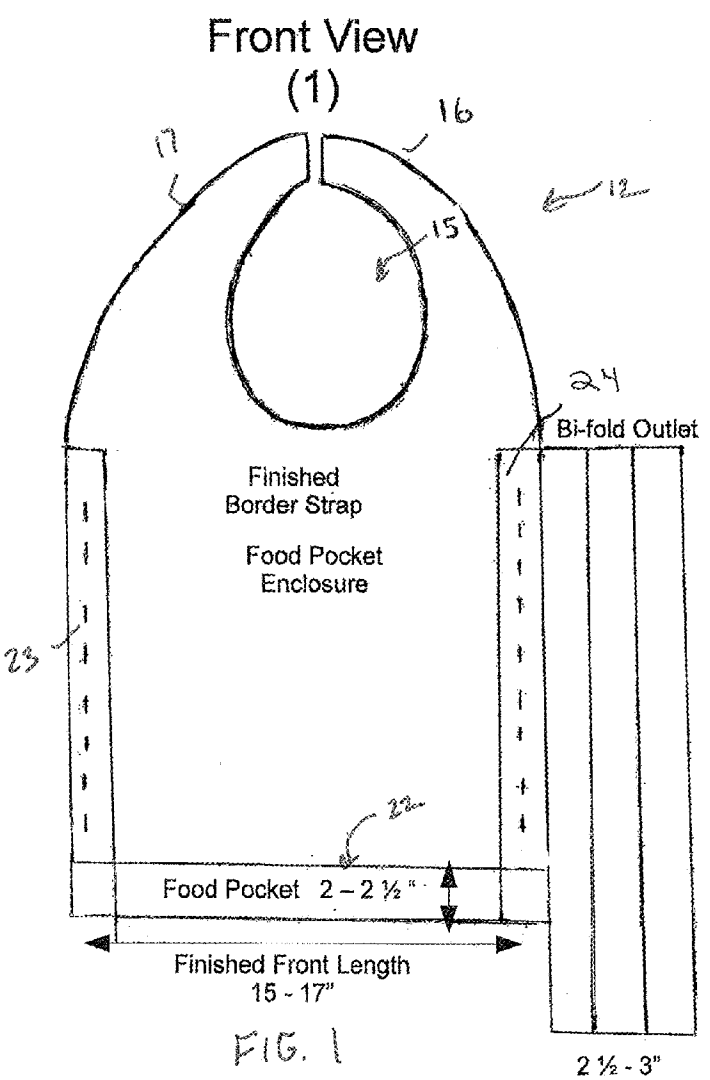
FIG. 1 depicts an exemplary embodiment of the front side of a food apron.
Figure 3:
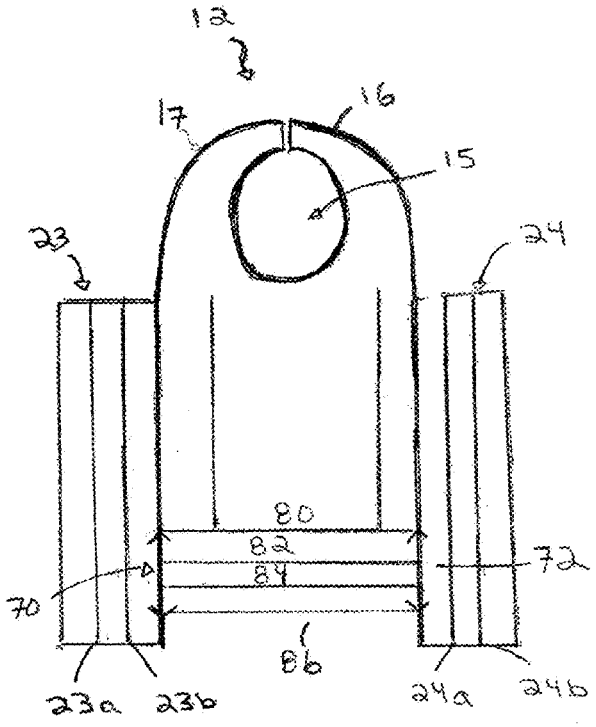
FIG. 3 depicts an additional exemplary embodiment of the front side of a food apron.

FIGS. 1 and 3 depict exemplary embodiments of the front portion of a food apron 12. The apron 12 is constructed from a unitary piece of material selected to be thin and flexible. In additional embodiments, the material used to created apron 12 is resistant to liquids so that food and other materials may be easily removed from the garment. In other embodiments, apron 12 may include a liner or backing attached to the back side (i.e., the side closest to the body of the wearer, see FIGS. 2 and 4), providing for additional comfort for the user. Referring again to FIGS. 1 and 3, the apron 12 includes a hole 15 through which a user's neck may extend while wearing the apron 12. The hole 15 is defined by a curved extension 16 that meets another curved extension 17. The ends of the curved extensions 16 and 17 may be coupled to one another via Velcro or other suitable attachment device (not shown).

As illustrated in FIG. 3, apron 12 includes two bifold straps 23 and 24 positioned on opposing sides of the bib material which extend from the bottom corners of the apron 12. In one exemplary embodiment, each strap 23 and 24 is an integral part of the apron 12 and extends along a side end of the apron past the bottom of the apron 12. The unitary material of apron 12 contains two cuts along lines 70 and 72, providing that bifold straps 23 and 24 are separated from the remainder of the apron below fold 80. Partial separation of bifold straps 23 and 24 provides the flexibility necessary for the creation of the front pocket 22 and for the straps 23 and 24 to wrap around the bottom of the apron 12, as will be discussed in more detail below. As illustrated in FIG. 1, bifold straps 23 and 24 may be folded along lines 23*a* and 23*b* (bifold 23) and 24*a* and 24*b* (bifold 24). These folds result in a strap with a smaller width. The bifold straps 23 and 24 may be secured to the back of the apron 12, as will be discussed in more detail below. In the folded orientation, bifold straps 23 and 24 create slightly raised channels along the edges of apron 12 which aid in directing any spilled materials along the length of the apron 12 and into the front pocket, as will be described in more detail below.

The bottom end of the apron 12 includes additional folds 82 and 84. In one embodiment, the bottom portion of apron 12 is folded upwards up along fold line 84 to form a pocket 22 (FIG. 1) along the front of the garment. The pocket 22 collects food or liquid materials that may fall onto the front portion of the apron 22. As described previously, the bifold straps 23 and 24 act to further direct food down the front of apron 22 into the pocket 22, preventing leakage of any such material onto the user's clothing or the tabletop/floor near the user.

Figure 4:
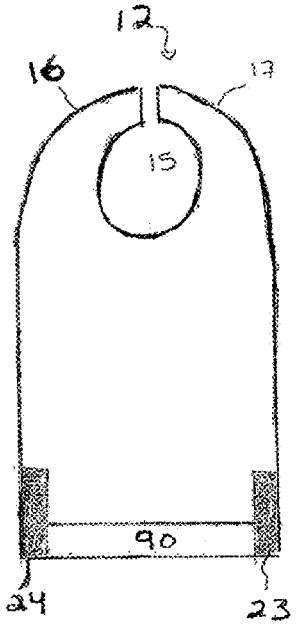
FIG. 4 depicts an additional exemplary embodiment of the back side of a food apron.

Turning now to FIGS. 2 and 4 which illustrate the back side of apron 12, it is illustrated that the ends of the straps 23 and 24 wrap around the bottom of the apron 12 and attach to attachment devices 33 and 34. The fact that the bifold straps 23 and 24 are partially detached from the apron 12 below fold 80 allows for them to wrap around the bottom of the apron 12. The attachment devices may be constructed from a material that will allow the bifold straps 23 and 24 to remain in place on the back of the apron 22. In one embodiment, attachment devices 33 and 34 may be constructed from one or more of a Velcro material, a magnet, a hook and eye, a snap, hook and loop fastener, or a button. In this regard, each strap 23 and 24 has an attachment device 43 and 44, respectively, such as a Velcro attachment that attaches to the corresponding attachment device 33 and 34 located on a backside of the apron 12. When so attached, the straps 23 and 24 hold the pocket 22 in place. Conversely, disengagement of attachment devices 33 and 34 will allow the pocket 22 to collapse and the flexible material of apron 22 to return to its flat orientation. This will allow for the easy removal of any food and will aid in cleaning of the apron 22.

In an additional embodiment, the apron includes an additional fold line 86 positioned below fold line 84. This extra length of material may wrap around the bottom of the apron 22 after creation of pocket 22. Securing bifold straps 23 and 24 as described above will create and secure a second pocket 90 on the back of apron 12. This additional pocket may be used, for example, to hold utensils or other material used during use of the apron 12, such as baby wipes or a washcloth.

Figure 5B:
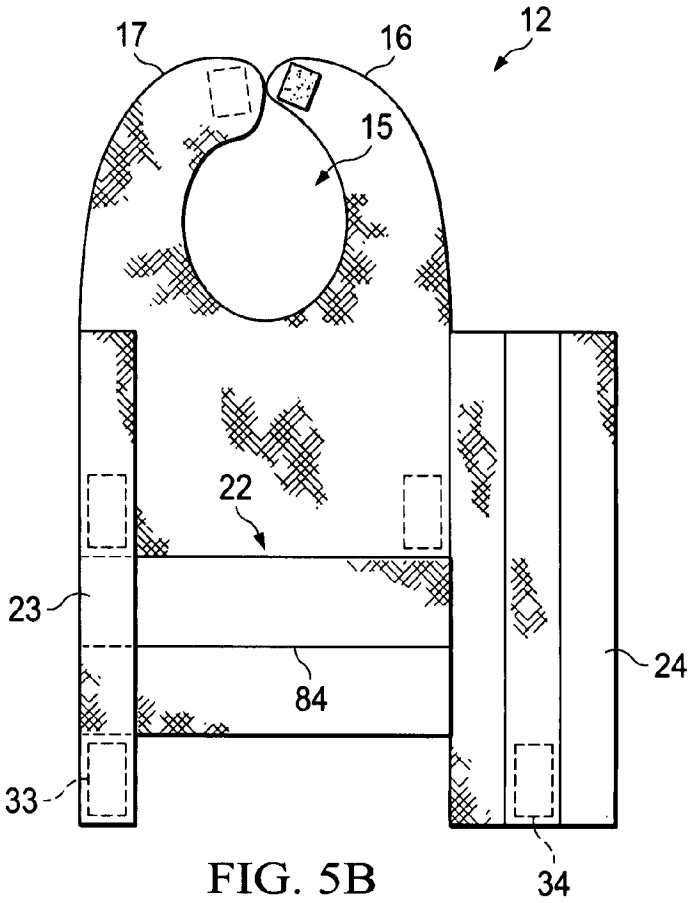
FIG. 5B depicts an exemplary embodiment of the front side of a partially assembled child-sized food apron.
Figure 5A:
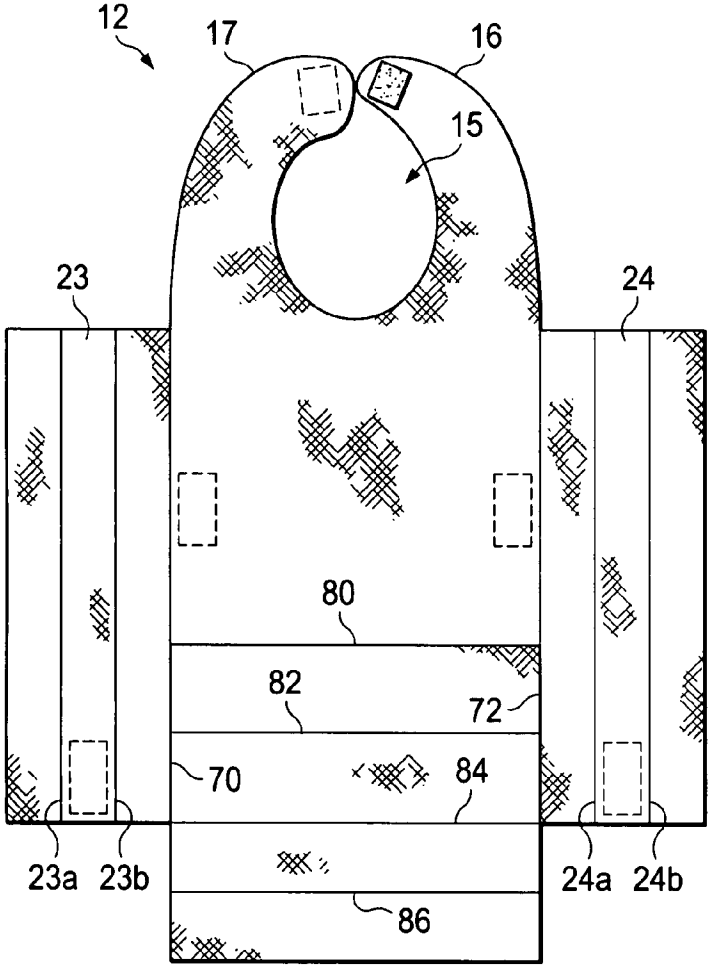
FIG. 5A depicts an exemplary embodiment of the front side of a disassembled child-sized food apron.
Figure 5D:
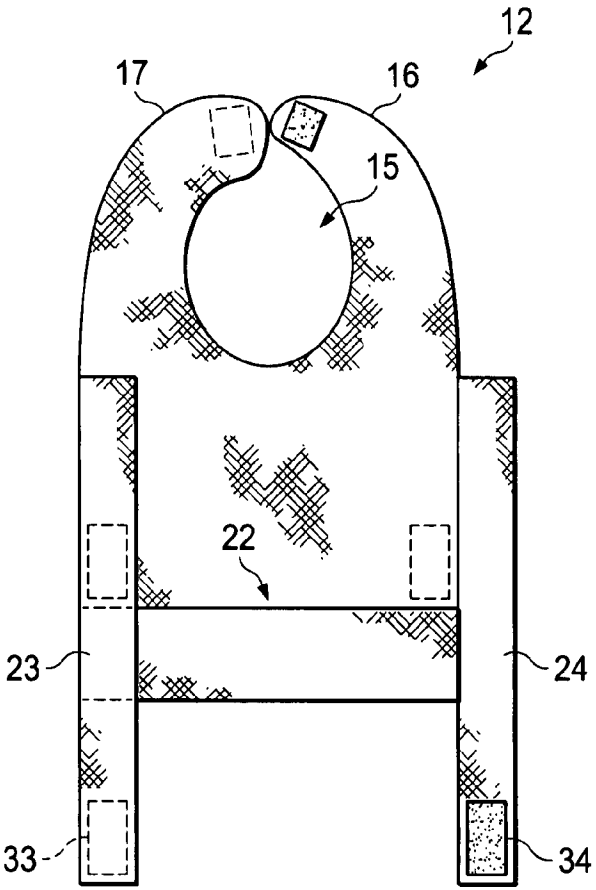
FIG. 5D depicts an additional exemplary embodiment of the front side of a partially assembled child-sized food apron.
Figure 5C:
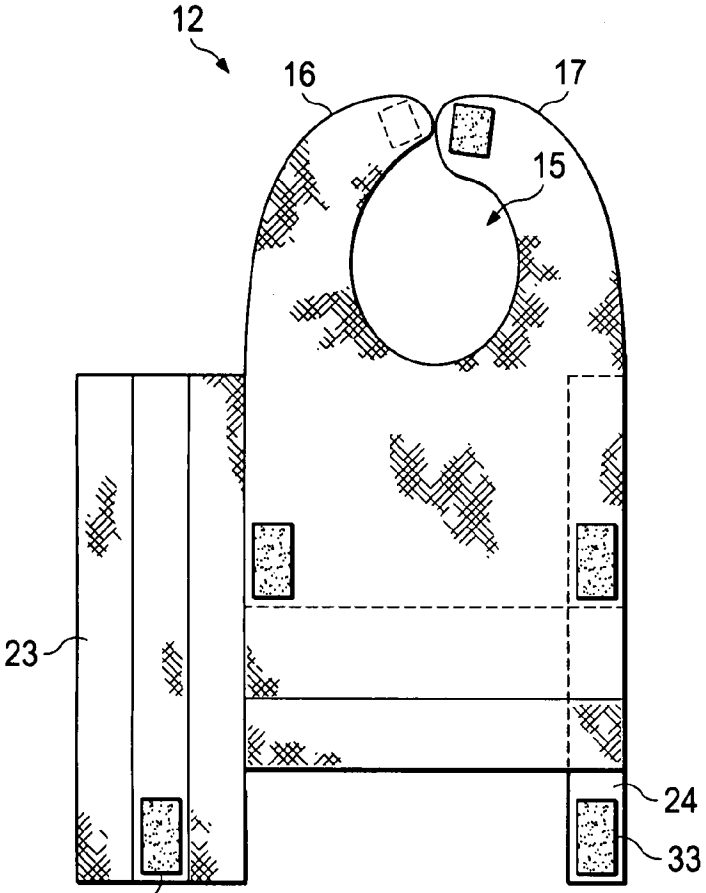
FIG. 5C depicts an exemplary embodiment of the back side of the partially assembled child-sized food apron as depicted in FIG. 5B.
Figure 5E:
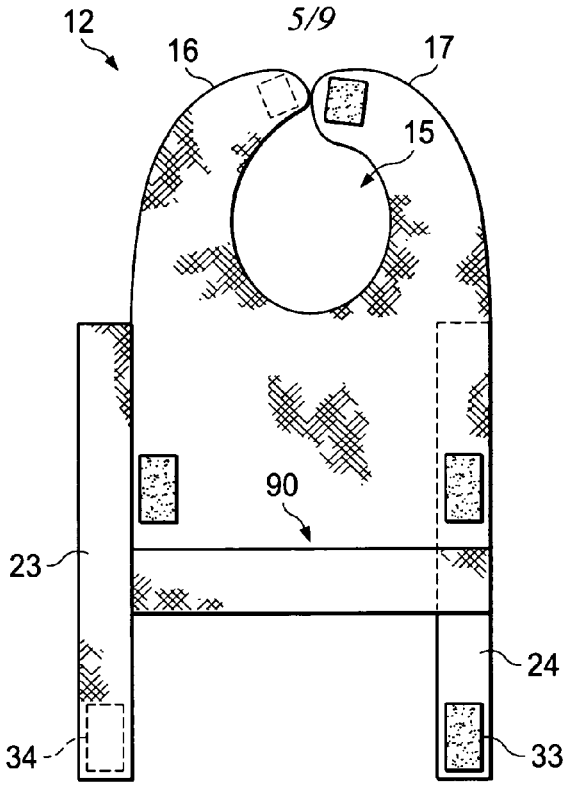
FIG. 5E depicts an exemplary embodiment of the back side of the partially assembled child-sized food apron as depicted in FIG. 5D.
Figure 5F:
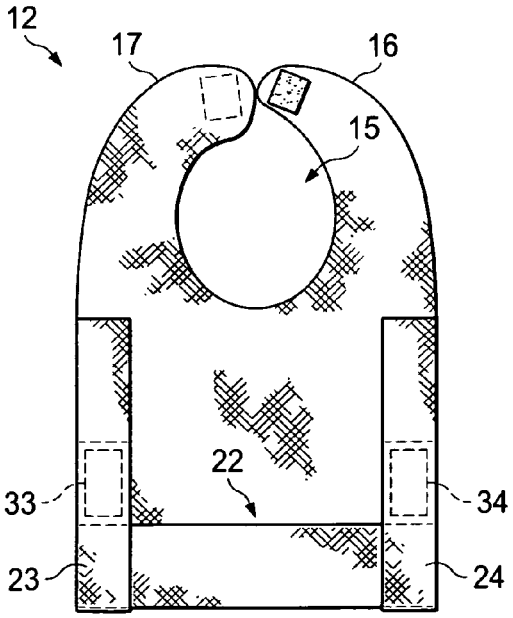
FIG. 5F depicts an exemplary embodiment of a fully assembled child-sized food apron.
Figure 5G:
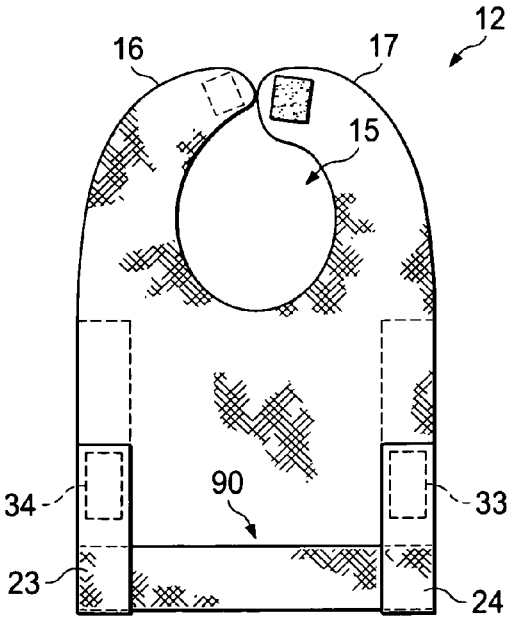
FIG. 5G depicts an exemplary embodiment of the back side of the assembled child-sized food apron as depicted in FIG. 5F.

FIGS. 5A-5G illustrate an embodiment of apron 12 appropriate for use with small children, such as infants or toddlers. This embodiment includes a one-piece apron 12 with a front pocket 22 which opens when the bifold straps 22 and 23 are detached from the back side of the apron 22. FIG. 5A illustrates the front side of the apron 22 with the bifolds 22 and 23 in the unfolded orientation. The pocket 22 is partially established with a bend at fold 84. FIG. 5B illustrates the front side of the child's apron 12 with bifold strap 23 in the folded position and a full front pocket 22. The back side of the apron of FIG. 5B is shown in FIG. 5C, which also includes back accessory pocket 90. FIG. 5D shows the front of a child's apron 12 with bifold strap 24 in the folded position and a full front pocket 22, while FIG. 5E illustrates the back side of FIG. 5D with a back accessory pocket 90. FIGS. 5F and 5G illustrate the front and back sides, respectively, of a fully assembled apron 22 appropriate for use by a child. The bifold straps 23 and 24 are completely folded and extended around the bottom of the apron 22 and secured by the attachment devices 33 and 34.

Figure 6B:
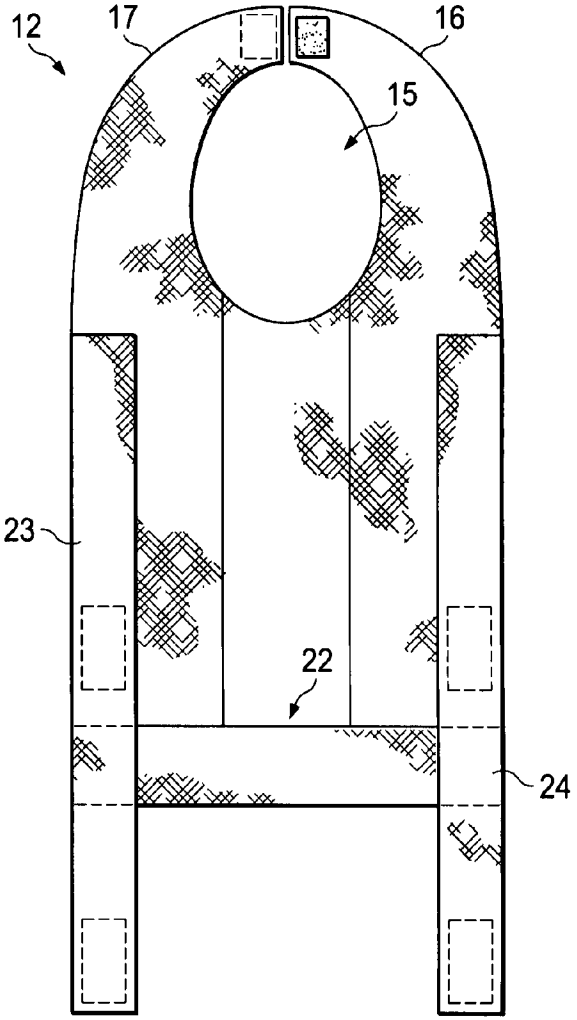
FIG. 6B depicts an exemplary embodiment of the front side of a partially assembled adult-sized food apron.
Figure 6A:
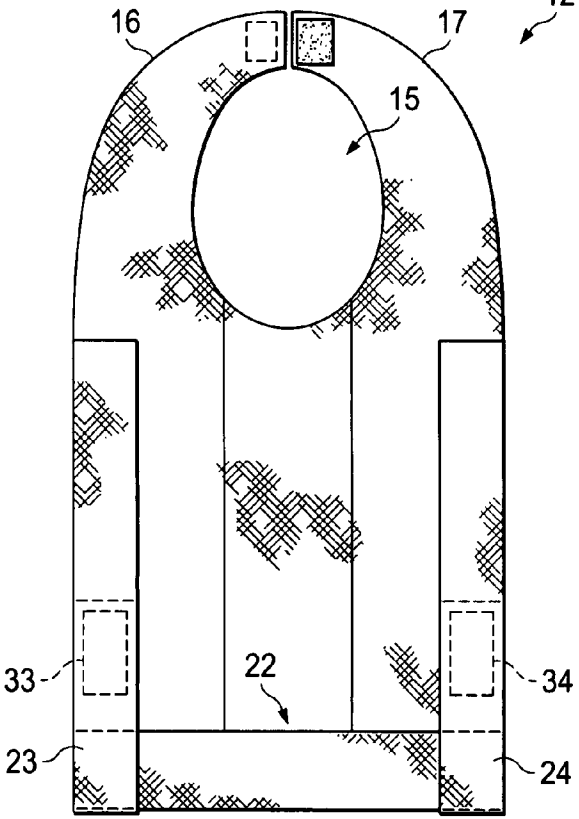
FIG. 6A depicts an exemplary embodiment of the front side of an assembled adult-sized food apron.
Figure 6C:
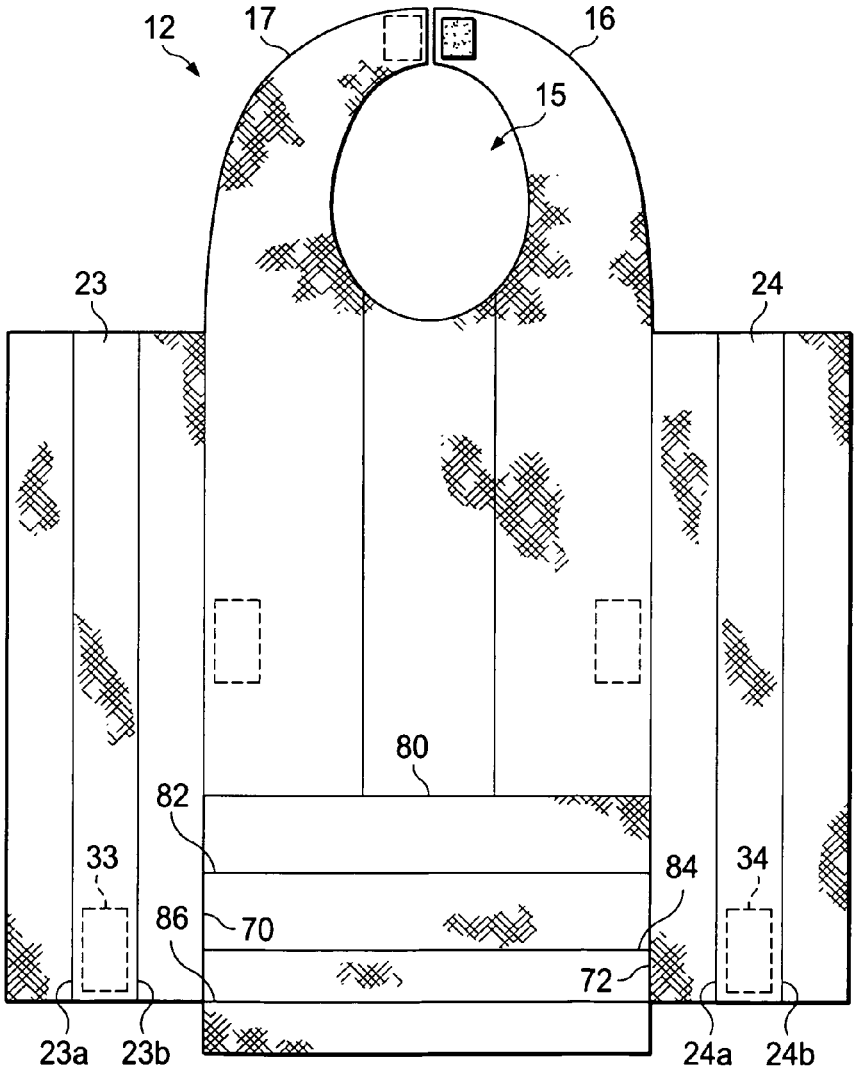
FIG. 6C depicts an exemplary embodiment of the front side of a disassembled adult-sized food apron.
Figure 6D:
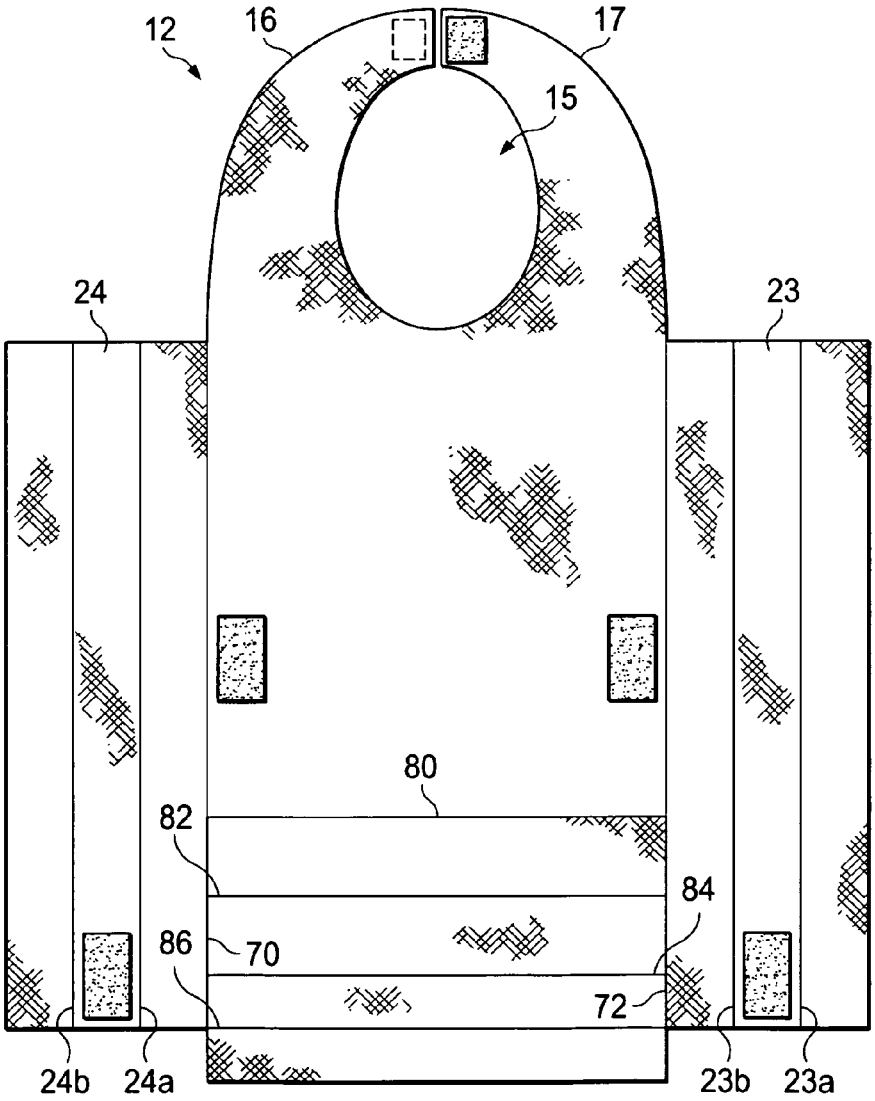
FIG. 6D depicts an exemplary embodiment of the back side of the disassembled adult-sized food apron as depicted in FIG. 6C.
Figure 6E:
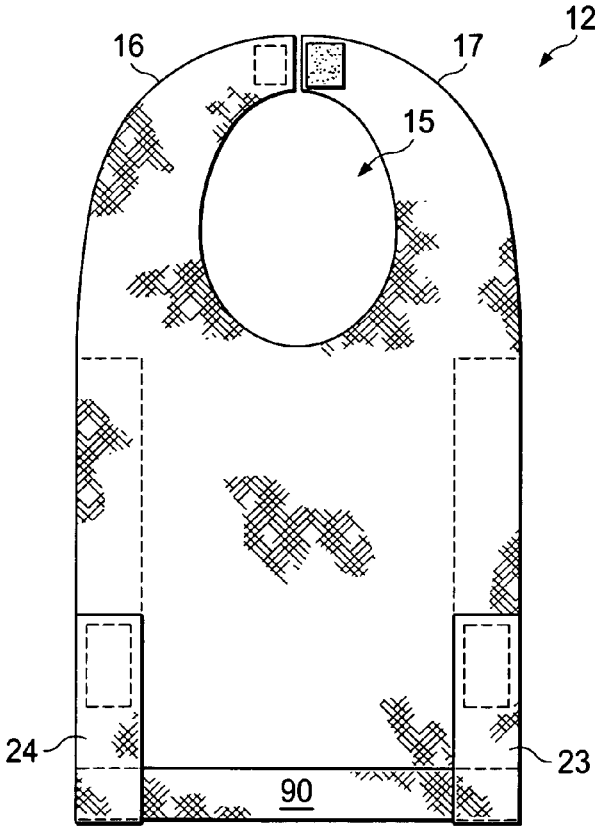
FIG. 6E depicts an exemplary embodiment of the back side of an assembled adult-sized food apron as depicted in FIG. 6A.

FIGS. 6A-E illustrate an adult sized apron 22. With reference to FIGS. 6A and 6B illustrating the front side of the apron 12, the bifold straps 23 and 24 are shown in the folded position. FIG. 6A illustrates the straps extended around the bottom of the apron 22, this securing pocket 22. The bifold straps 22 and 23 create a seam to direct food and liquids into pocket 22. FIG. 6B illustrates an embodiment of the apron 12 where the straps in the unsecured position. FIG. 6C displays a front view of the adult sized apron 12 with the bifold straps 23 and 24 in the unsecured orientation and the pocket 22 in the open position. Waste materials are easily removed from the apron 12 in this position. FIG. 6D illustrates the reverse side of the adult apron 12 illustrated in FIG. 6C. FIG. 6E illustrates the back side of a fully assembled apron 12, including fully attached bifold straps 23 and 24 and a completed accessory pocket 90.

In use, the user folds the two bifold straps 23 and 24 in an accordion-like fashion along lines 23*a*, 23*b* and 24*a*, 24*b* to form a strap with a smaller width. The user then folds the bottom portion of apron 12 upwards along fold line 84 to form a pocket 22 (see FIG. 1) along the front of the garment. Optionally, the user may further fold the bottom portion of apron 12 along line 86 and wrap the end to lay on the back side, forming back accessory pocket 90. The user may then fold the bifold straps 23 and 24 to the back side of apron 12 and secure them to the back side via attachment devices 33 and 34. Flexible pockets 22 and 90 are secured to the apron 12 will retain their positions on the front and back sides of the garment.

The pocket 22 collects food or liquid materials that may fall onto the front portion of the apron 22. As described previously, the bifold straps 23 and 24 act to further direct food down the front of apron 22 into the pocket 22, preventing leakage of any such material onto the user's clothing or the tabletop/floor near the user.

A user wears the apron 12 around his neck and food or liquids spilled on the apron 12 are pulled by gravity to the pocket 22, which catches and holds such food and liquids. Each strap 23 and 24 forms a border that prevents the food and liquids from sliding off of the side ends of the apron 12 thereby guiding the food and liquids to the pocket 22. The external material of the apron is preferably slick to provide a low friction surface that permits the food and liquid to slide to the pocket 22 with little resistance. In one embodiment, the external material is vinyl-based, but other types materials are possible in other embodiments.

Attached herewith is a description of an exemplary embodiment of an apron 12. The provided dimensions and configuration are exemplary. It would be apparent to a person of ordinary skill upon reading this disclosure that various other dimensions and design changes are possible.

The invention claimed is:

1. A food apron, comprising:

a flexible material having a hole defined by a first curved extension and a second curved extension, where the first and second curved extensions meet;

a first and second folding strap positioned on opposing sides of the flexible material, wherein the first and second folding straps are partially detached from the flexible material and wherein the first and second folding straps extend around a bottom of the flexible material;

a first flexible pocket positioned on a front side of the flexible material, the pocket formed by an upward fold in the flexible material;

a second flexible pocket positioned on a back side of the flexible material; and an attachment device positioned on the back side of the flexible material, wherein securing the first and second folding straps to the attachment device prevents unfolding of the first flexible pocket.

2. The food apron of claim 1, wherein securing the first and second folding straps to the attachment device prevents unfolding of the second flexible pocket.

* * * * *